US005456178A

United States Patent [19]

Henn et al.

[11] Patent Number: 5,456,178

[45] Date of Patent: Oct. 10, 1995

[54] PRINTING MACHINE WITH SHEET-GUIDING SURFACE

[75] Inventors: Manfred Henn, Heidelberg; Josef Wehle, Schwetzingen; Jürgen Zeltner, Heidelberg, all of Germany

[73] Assignee: Heidelberger Druckmaschinen AG, Heidelberg, Germany

[21] Appl. No.: 176,114

[22] Filed: Dec. 30, 1993

[30] Foreign Application Priority Data

Dec. 30, 1992 [DE] Germany ..... 42 44 499.3

[51] Int. Cl.[6] ..... B41F 1/28

[52] U.S. Cl. ..... 101/407.1; 101/409; 101/420; 271/279

[58] Field of Search ..... 101/181, 142, 101/230, 407.1, 408, 409, 410, 411, 412, 420, 231, 232, 216, 217; 271/276, 309, 310, 197, 195, 196; 406/88

[56] References Cited

U.S. PATENT DOCUMENTS

| | | | |
|---|---|---|---|
| 3,986,455 | 10/1976 | Jeschke et al. | 101/409 |
| 4,310,152 | 1/1982 | Mitzel | 271/309 X |
| 4,722,276 | 2/1988 | Tyler | 101/420 X |
| 4,930,414 | 6/1990 | Wirz | 101/230 |
| 5,127,329 | 7/1992 | DeMoore et al. | 271/276 X |
| 5,156,090 | 10/1992 | Wirz | 101/142 |
| 5,228,391 | 7/1993 | DeMoore et al. | 101/420 |
| 5,243,909 | 9/1993 | DeMoore et al. | 101/420 |

FOREIGN PATENT DOCUMENTS

| | | | |
|---|---|---|---|
| 3328451 | 2/1985 | Germany | 101/409 |
| 8437444.8 | 3/1985 | Germany . | |
| 3622515 | 2/1987 | Germany . | |
| 2169243 | 4/1989 | United Kingdom . | |

*Primary Examiner*—Chris A. Bennett

*Attorney, Agent, or Firm*—Herbert L. Lerner; Laurence A. Greenburg

[57] ABSTRACT

Printing machine with a sheet-guiding surface, at least part of which is a cover surface of a pneumatic-flow box, the cover surface being formed with pass-through openings for pneumatic fluid, includes a pneumatic-flow nozzle connecting the pneumatic-flow box to a source for supplying pneumatic fluid to the pneumatic-flow box, the pneumatic-flow box having a flow resistance profile decreasing therein with increasing distance from a location at which the pneumatic-flow nozzle is connected to the pneumatic-flow box.

13 Claims, 5 Drawing Sheets

PRINTING MACHINE WITH SHEET-GUIDING SURFACE

BACKGROUND OF THE INVENTION

FIELD OF THE INVENTION

The invention relates to a printing machine with a sheet-guiding surface, at least part of which is a cover surface of a respective pneumatic-flow box, such as a blowing box for blowing air and a suction box for suction air, the cover surface being formed with pass-through openings.

For reliable sheet guidance, it has become known heretofore to form parts of sheet-guiding surfaces as blowing/suction-box cover surfaces formed with pass-through or passageway openings. Especially in the sensitive curvature regions of a delivery drum of a chain delivery and of a preceding printing cylinder of the last printing unit, respectively, printed sheets of paper undergo very pronounced deflections. In this regard, it should be noted that, because of the extreme curvatures of the sheets of paper, the rear or trailing portion of the sheets readily departs from the sheet-guiding plane therefor. Damage to the printed image and to the sheet cannot be precluded in that case. At low conveying speeds, it should be noted that, in the region of the delivery drum wherein the sheet is taken over by the front or leading edge thereof by the delivery drum and wherein the front or leading edge is then passed, with a change of direction, beneath a rear or trailing region of the sheet, the rear or trailing edge of the sheet frequently flaps over in the direction of the axis of the delivery drum, and the rear or trailing edge of the sheet becomes damaged on elements of the delivery drum. If the printing machine is briefly stopped, the paper sheets in conventional suction box guides can tip over in the middle region of the delivery drum. Flapping-in or folding-in of the sheets at low speeds and with a brief stoppage of the printing machine also causes the sheets to wrap around the gripper bars of the delivery chains. The wound-up sheets of paper must be removed by tedious, time-consuming manual labor on the part of the operator. If they are not removed, they will continue to revolve with the gripper chain and can cause damage to the printing machine. Particularly at such critical deflection locations, it is especially important that the entire sheet-guiding region as much as possible, but at least the critical portion in the sheet guide, be reliably made. With heretofore known suction or blowing bars in the delivery drum region, only some regions are reliably guidable. Conventional suction/blowing boxes for sheet guiding, with a suction/blowing connection or nozzle optimally extending, as centrally as possible and with a large surface area, over the entire suction or blower region, are not readily usable, because of the tightness of space, especially in the region of the delivery drum. Suction/blowing boxes with a suction box region of narrow construction and with simple suction and blowing nozzles, respectively, which are undesirably disposed because of the tightness of space do not afford a safe and reliable sheet guidance over the entire suction box and or blowing box region, respectively, because of the high flow losses.

It is accordingly an object of the invention to provide a printing machine having a sheet-guiding surface, at least part of which is a cover surface of a respective pneumatic-flow or blowing/suction box, the cover surface being formed with pass-through openings, which ensure a reliable sheet guidance over the entire cover surface of the blowing/suction box.

SUMMARY OF THE INVENTION

With the foregoing and other objects in view, there is provided, in accordance with the invention, a printing machine with a sheet-guiding surface, at least part of which is a cover surface of a pneumatic-flow box, the cover surface being formed with pass-through openings for pneumatic fluid, comprising a pneumatic-flow nozzle connecting the pneumatic-flow box to a source for supplying pneumatic fluid to the pneumatic-flow box, the pneumatic-flow box having a flow resistance profile decreasing therein with increasing distance from a location at which the pneumatic-flow nozzle is connected to the pneumatic-flow box.

The flow resistance profile, depending upon the distance from the pneumatic-flow nozzle, with the flow resistance decreasing with increasing distance from the connection location of the nozzle and the box, assures a uniformity of the flow conditions in the region of the cover surface over the entire pneumatic-flow box.

Hence, uniform sheet guidance over the entire cover surface region of the pneumatic-flow box is possible. Even narrow pneumatic-flow boxes with an extremely off-center nozzle opening for the source for supplying pneumatic fluid can thus be used for secure and reliable sheet guidance.

In accordance with another feature of the invention, there are included a pneumatic-flow path extending from the connection location in the pneumatic-flow box, and flow resistance-forming bodies extending from the cover surface into the pneumatic-flow path in the pneumatic-flow box and being disposed in succession therein, the bodies offering respective flow resistances to the pneumatic fluid which decrease with increasing distance from the connection location.

In accordance with a further feature of the invention, the flow-resistance-forming bodies are baffles.

In accordance with an added feature of the invention, the baffles have a varying length and decrease in length with increasing distance thereof along the pneumatic-flow path from the connection location.

In accordance with an alternative feature of the invention, the baffles are disposed in the pneumatic-flow path at respective angles to oncoming pneumatic flow which decrease with increasing distance of the baffles from the connection location.

In accordance with another alternative feature of the invention, respective spacings between respective mutually adjacent pairs of the baffles increase with increasing distance of the baffles from the connection location.

In accordance with another aspect of the invention, there is provided a printing machine with a sheet-guiding surface, at least part of which is a cover surface of a suction box, the cover surface being formed with pass-through openings for suction air, comprising a suction nozzle connecting the suction box to a source for supplying suction air to the suction box, the suction box having a flow resistance profile decreasing therein with increasing distance from a location at which the suction nozzle is connected to the suction box.

In accordance with yet another feature of the invention, a delivery drum is included having a sheet-guiding region for effecting a deflection of a guided sheet, the suction box is secured outside the delivery drum, and the sheet-guiding cover surface thereof is disposed concentrically with the delivery drum and is formed with perforations disposed in accordance with the deflection.

In accordance with an alternative aspect of the invention, there is provided a printing machine with a sheet-guiding surface, at least part of which is a cover surface of a blowing box, the cover surface being formed with pass-through openings for blowing air, comprising a blast nozzle connecting the blowing box to a source for supplying blowing air to the blowing box, the blowing box having a flow resistance profile decreasing therein with increasing distance from a location at which the blast nozzle is connected to the blowing box.

In accordance with yet a further feature of the invention, the printing machine includes an impression cylinder having a sheet-guiding region for effecting a deflection of a guided sheet, the blowing box being secured outside the impression cylinder, the pass-through openings formed in the sheet-guiding cover surface of the blowing box being perforations arranged for guiding the sheet from outside the impression cylinder.

In accordance with yet an added feature of the invention, the cover surface is concentric with the impression cylinder and faces from outside the impression cylinder towards the sheet-guiding region of the impression cylinder.

In accordance with yet an additional feature of the invention, the printing machine includes a delivery drum having a sheet-deflecting guiding region, the suction box being secured within the delivery drum, and the cover surface of the suction box facing towards the sheet-deflecting guiding region of the delivery drum, the cover surface being disposed concentrically with the delivery drum and being formed with perforations disposed in accordance with the deflection of a deflected sheet.

The provision of baffles in the invention of the instant application for providing the flow-resistance profile is especially advantageous and readily achieved. Especially simple, economical resistance bodies having flow performance relationships which can be described relatively easily are possible when they are formed as baffles. The foregoing additional structural features and arrangements of the baffles permit an especially simple, economical, and relatively easily adjustable formation of the flow profile in order to make the flow behavior uniform in the cover surface of the blower/suction box.

In accordance with a concomitant aspect of the invention, there is provided a printing machine with a sheet-guiding surface, at least part of which is a cover surface of a blowing box, the cover surface being formed with pass-through openings for blowing air, comprising a blast nozzle connecting the blowing box to a source for supplying blowing air to the blowing box, the blowing box having a flow resistance profile decreasing therein with increasing distance from a location at which said blast nozzle is connected to the blowing box, an impression cylinder having a sheet-guiding region for effecting a deflection of a guided sheet, the blowing box being secured outside said impression cylinder, said pass-through openings formed in said sheet-guiding cover surface of the blowing box being perforations arranged for guiding the sheet from outside the impression cylinder, and including a delivery drum having a sheet-deflecting guiding region, a suction box secured within said delivery drum and having a cover surface facing towards said sheet-deflecting guiding region of said delivery drum, said cover surface of said suction box being disposed concentrically with said delivery drum and being formed with perforations disposed in accordance with the deflection of a deflected sheet.

The use of the foregoing suction box in the region of the delivery drum and the use of the foregoing blowing box in the deflection region on the impression cylinder are especially advantageous. Both provisions together permit secure sheet guidance over the entire critical S-shaped double deflection region of the impression cylinder and delivery drum, after the last printing job has been performed.

Other features which are considered as characteristic for the invention are set forth in the appended claims.

Although the invention is illustrated and described herein as embodied in a printing machine with a sheet-guiding surface, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENT

Figure 1:
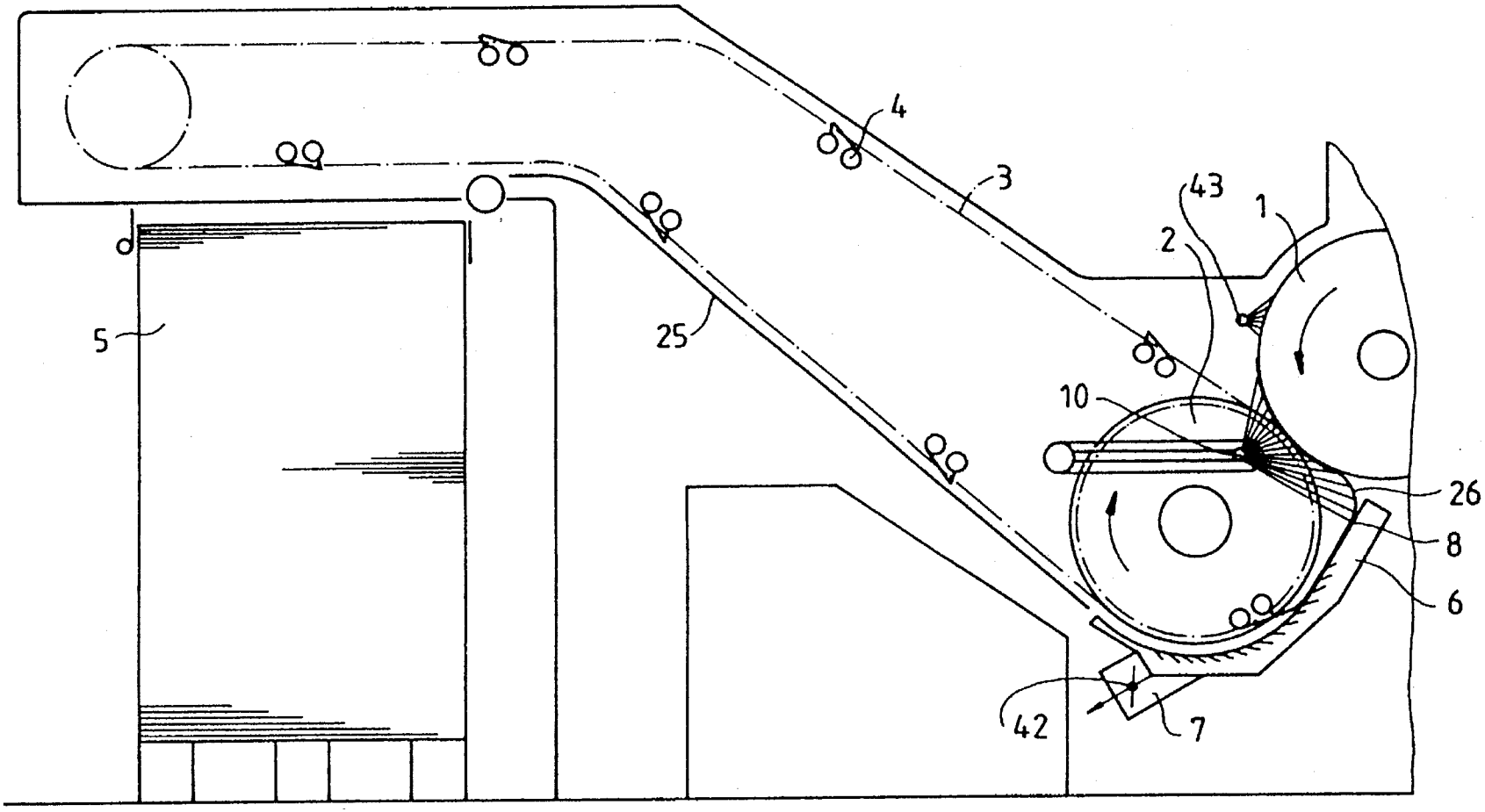
FIG. 1 is a diagrammatic side elevational view of a chain delivery of a sheet-fed offset rotary printing machine having, as one embodiment of the invention, a curved suction box disposed in the vicinity of the delivery drum.

Referring now to the drawings and, first, particularly to FIG. 1 thereof, there is shown therein a delivery region of a sheet-fed offset rotary printing machine wherein, in a conventional manner, sheets of paper are transported from an impression cylinder 1 of a last printing unit of the printing machine, with the aid of gripper bars 4 fastened to chains 3 revolving about sprocket wheels of a delivery drive shaft for the delivery drum 2, via a sheet-guiding surface 25 to a location above a delivery pile 5, and are deposited thereon.

Figure 4:
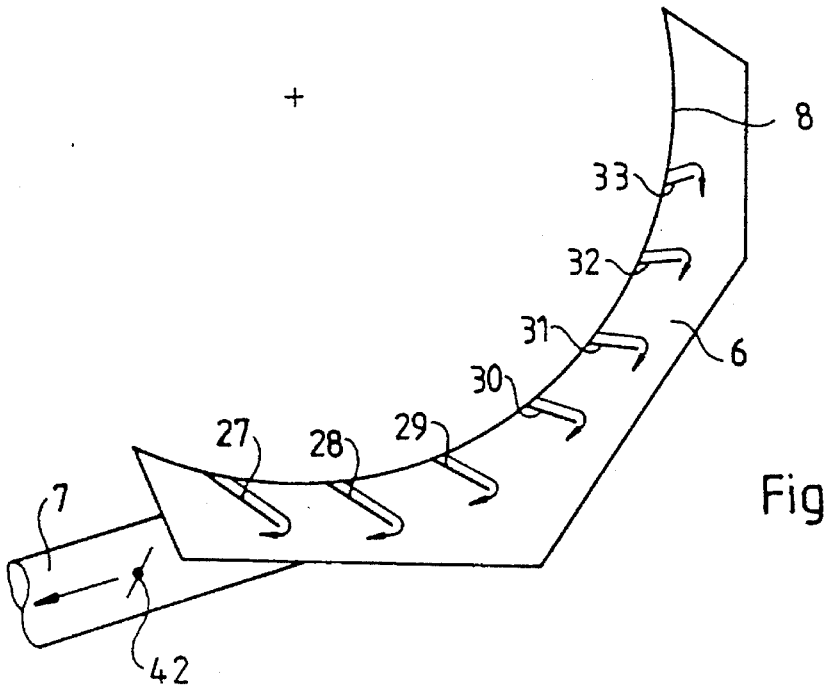
FIG. 4 is a diagrammatic side elevational view of a sixth embodiment of the suction box which is disposed in the vicinity of the delivery drum, is curved and has an off-center suction-air connection.
Figure 8:
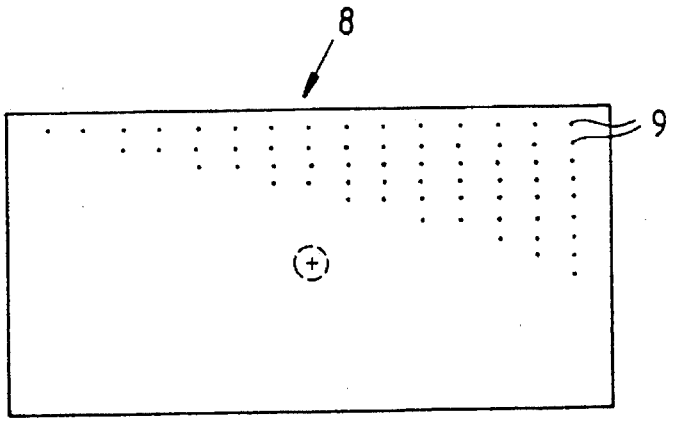
FIG. 8 is a plan view of a suction/blowing box according to the invention showing respective suction and air-blowing holes formed therein.

A paper sheet 26, which has been taken over by a gripper bar 4, thus initially follows the curvature of the impression cylinder 1 and then is pulled onto the cover plate 8 of the suction box 6 by suction which, via the suction nozzle 7, the suction box 6 and pass-through openings 9 (note FIG. 8) formed in the cover plate 8, acts upon the side of the sheet 26 facing away from the delivery drive shaft and drum 2. The cover plate 8 basically follows the curvature of the delivery drive shaft and drum 2. With the aid of a blower tube 10, the rear or trailing edge of the sheet, directly in the region of sheet transfer from the impression cylinder 1 to the delivery drum 2, is forced outwardly by blowing air from the delivery drum 2, so that the rear or trailing edge of the sheet 26 initially rests on the impression cylinder 1 even after the sheet transfer. The sheet is then deflected in a small radius by the impression cylinder 1 and is guided directly onwardly by the cover surface 8 of the suction box 6. As shown in FIG. 4, baffles 27, 28, 29, 30, 31, 32 and 33, for example, punched out of and extending inwardly from the cover plate or metal sheet 8 remain suitably secured in the suction box 6. The baffles act as flow resistors for the suction-air flow, and are so formed that the respective flow resistance of the baffles is reduced with increased spacing of the various baffles from the suction nozzle 7. As a result, assurance is provided that the suction air will uniformly impinge upon the sheet virtually over the entire cover plate 8 of the suction box 6.

Figure 2A:
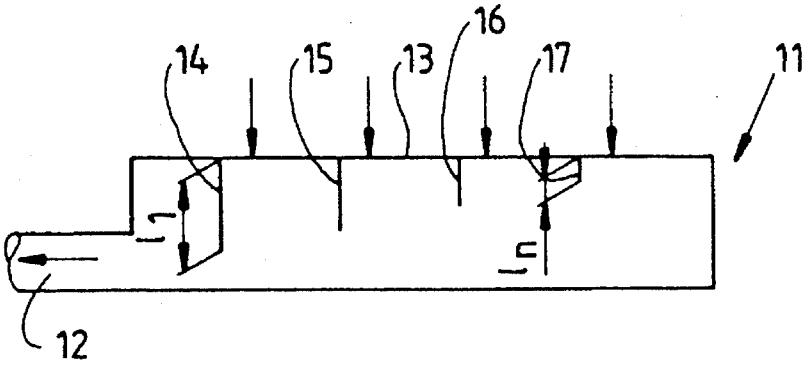
FIGS. 2*a*, 2*b* and 2*c* are diagrammatic side elevational views of other embodiments of the suction box according to the invention, which is straight and has a guide surface of varying length in FIG. 2*a*, has guide surfaces with varying spacing therebetween in FIG. 2*b*, and has various baffles disposed at varying setting angles in FIG. 2*c*.
Figure 2B:
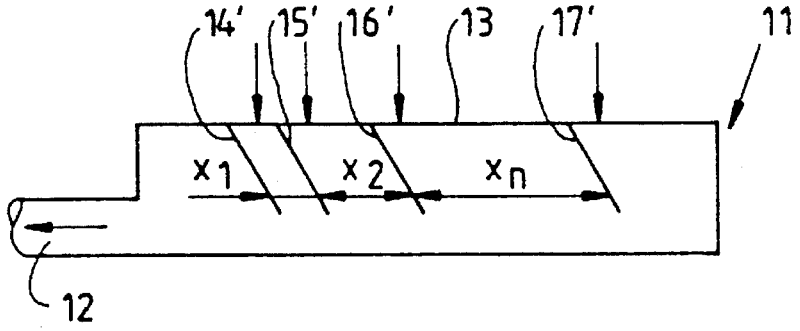
Figure 2C:
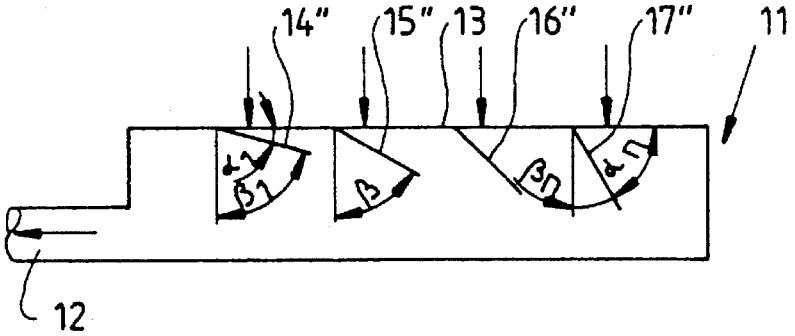

As shown in FIGS. 2*a*, 2*b* and 2*c*, a suction box 11 with a non-curved, but rather, straight or rectilinear, flat sheet-guiding cover surface 13, for example, may be provided in accordance with the invention, wherein the flow resistance of baffles which are spaced at an increasing distance from the suction nozzle 12 can be achieved in various ways. In FIG. 2*a*, the baffles 14, 15, 16 and 17 are formed with varying lengths, the baffle 14 which is closest to the suction nozzle 12 being the longest. The baffle 15 is chosen to be somewhat shorter, the baffle 16 even shorter yet, and the baffle 17 the shortest. In FIG. 2*b*, the distances x between respective adjacent baffles are increased with increasing distance from the suction nozzle 12. Thus, the distance between the baffle 14' and the baffle 15' is the shortest distance, and the distance between the baffles 16' and 17' is the longest distance. In FIG. 2*c*, the angle $\alpha$ between the baffle and the cover face 13 is increased with increasing distance from the suction nozzle 12. Thus, the angle $\alpha_1$ of the baffle 14" is the smallest angle, while the angle $\alpha_n$ of the baffle 17" is the largest angle. The oncoming flow angle $\beta$ varies precisely inversely from the angle between the baffle and the oncoming flow direction, and is largest for the baffle 14" and smallest for the baffle 17".

Both with the suction box having the straight cover plate 13 and with a suction box having a curved cover plate 8, it is useful, especially for narrowly built suction boxes having a virtually point-like suction-air inlet, to employ several of the measures illustrated in FIGS. 2*a*, 2*b* and 2*c*. A suction box 11 with a straight cover plate 13 as shown in these figures can be employed sensibly for better sheet guidance also in the region of the sheet-guiding surface 25 (FIG. 1) of the delivery, and can also be usefully employed in the region of the sheet feeder for better sheet guidance.

Figure 3:
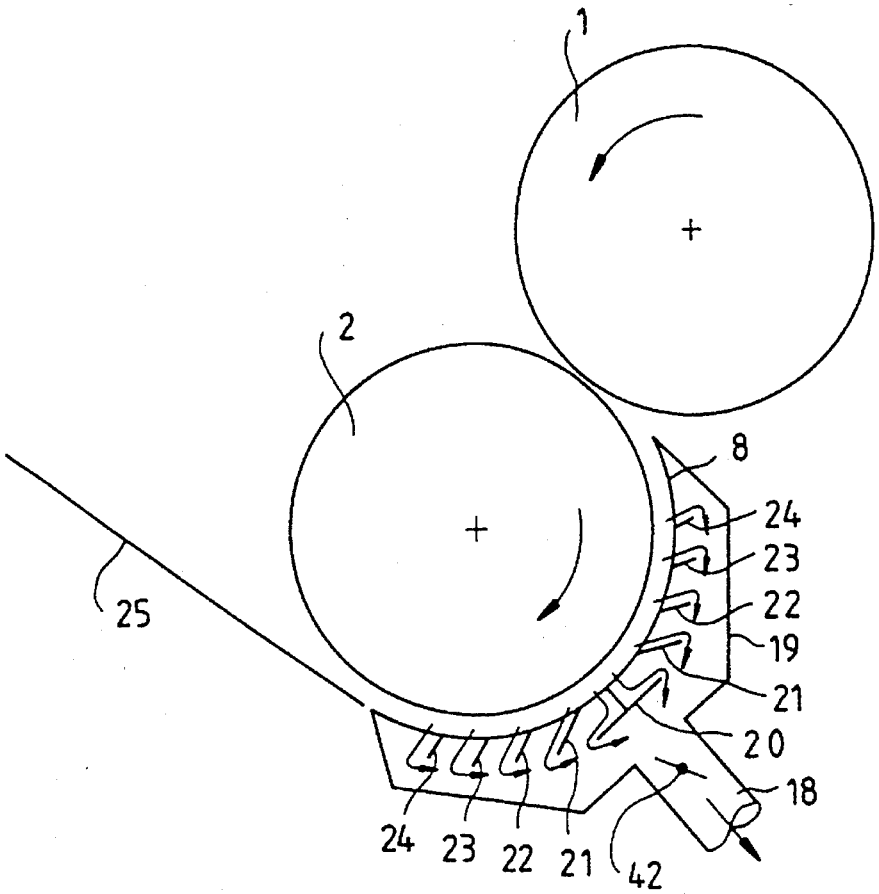
FIG. 3 is a diagrammatic side elevational view of a fifth embodiment of the suction box which is disposed in the vicinity of the delivery drum, is curved and has a central suction-air connection.

With a central point-like suction-air inlet into a suction box of narrow construction, it is also possible, as shown in FIG. 3, to secure an end plate 20 directly opposite the inlet of the suction nozzle 18 into the suction box 19, and to secure the baffles 21, 22, 23 and 24 in a distributed manner on both sides of the end plate 20 and counter to the sheet feeding direction. Once again, the flow resistance profile of the baffles is selected so that the baffle 21 which is closest to the suction nozzle 18 has the greatest flow resistance, and the baffles located farther away have a lesser flow resistance as the distance thereof from the suction nozzle 18 increases.

Figure 5:
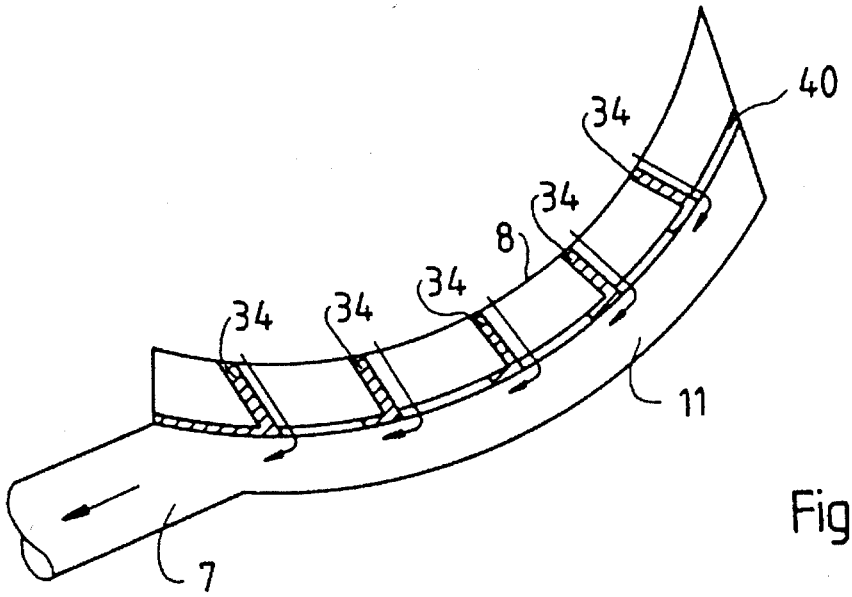
FIG. 5 is a diagrammatic side elevational view of a seventh embodiment of the suction box which is curved and provided with baffles which have been bent in a counter-clockwise direction towards the sheet-guiding surface.
Figure 6:
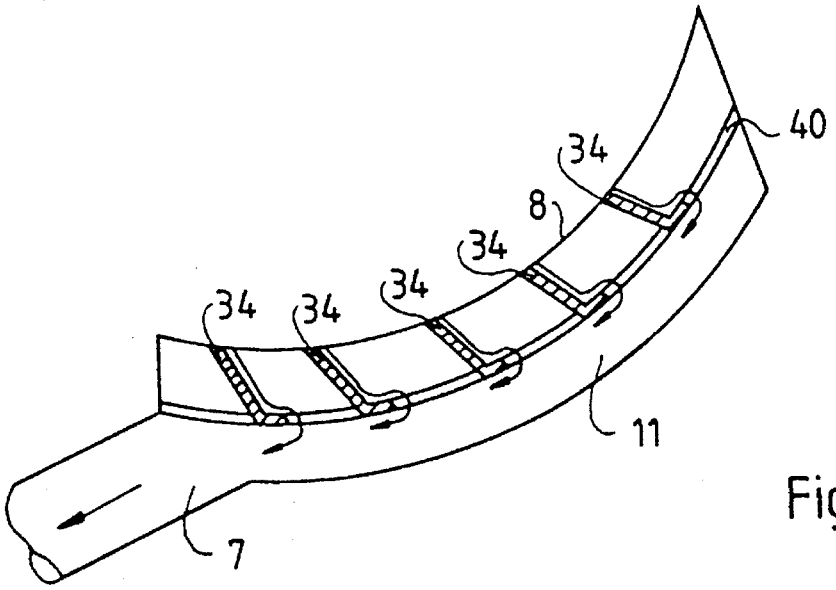
FIG. 6 is a view like that of FIG. 5 of the curved suction box with the baffles thereof bent in a clockwise direction towards the sheet-guiding surface.

In FIGS. 5 and 6, the baffles of the suction box 11 are produced from a stamped or punched metal plate, with the punched-out tabs 34, respectively, being bent away from the attachment line 40 thereof in a direction towards the cover plate 8, the punched-out tabs 34 then being the baffles. The only difference between the embodiments of FIGS. 5 and 6 is that the tabs 34 in FIG. 5 have been bent away from the attachment line 40 in a counter-clockwise direction towards the cover plate 8, whereas the tabs 34 in FIG. 6 have been bent away in a clockwise direction.

Figure 7:
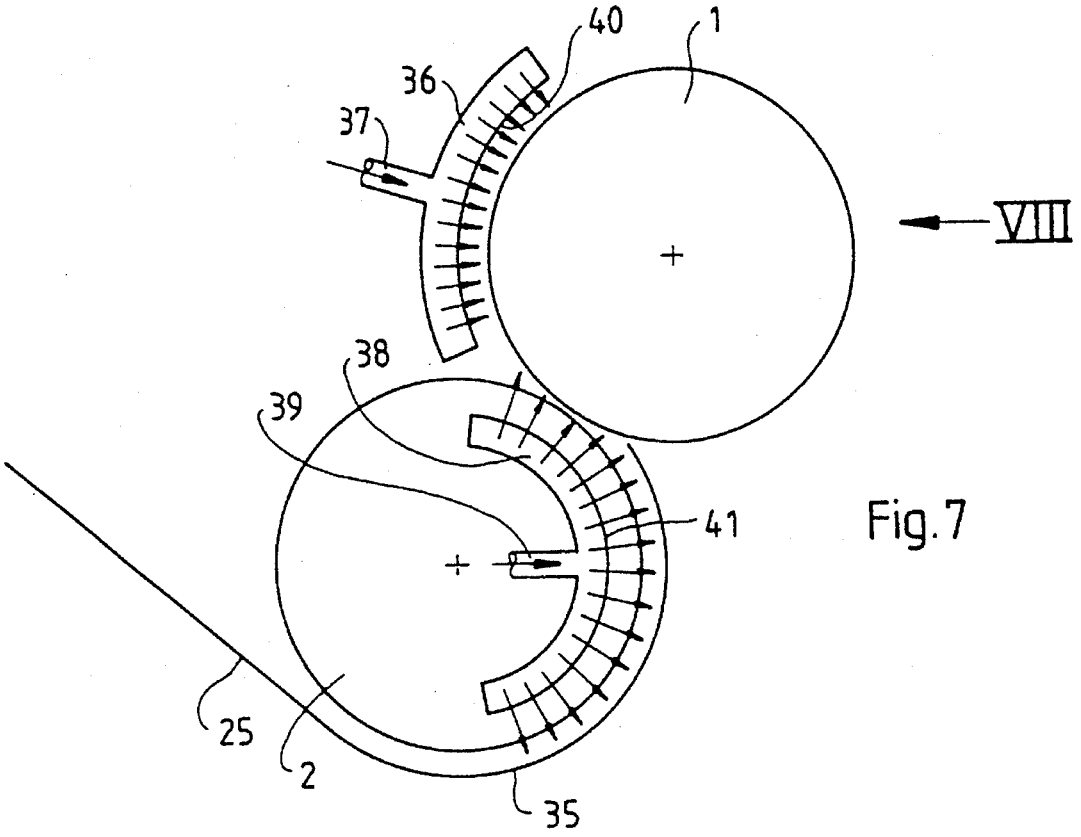
FIG. 7 is a diagrammatic and schematic view of an embodiment of the invention wherein respective blowing boxes are disposed in the vicinity of an impression cylinder and the delivery drum.

As shown in FIG. 7, it is also conceivable to install, within a cylindrical space formed between the sprocket or chain wheels of the delivery drive shaft, a blowing box 38 which extends over the sheet guidance region and is bent concentrically to the delivery drive shaft and drum 2, the blowing box 38 having a concentric cover plate 41 formed with pass-through openings 9. To provide uniform pressure distribution in the blowing box 38, baffles extending into the blowing box 38 are also secured therein to the cover plate 41 so that with increasing spacing thereof from the inlet of blast nozzle 39, the baffles exhibit a decreasing flow resistance. The paper sheet conveyed from the impression cylinder 1 and around the delivery drive shaft and drum 2 is thus acted upon uniformly over virtually the entire guidance region by radially outwardly flowing blowing air, and thus is securely guided between a sheet guide plate 35 and the delivery drive shaft and drum 2.

To improve sheet guidance, it is also conceivable to dispose a blowing box 36 having a blast nozzle 37 and a curved cover surface 40 concentrically with the impression cylinder 1, the cover surface 40 being formed with pass-through openings 9 and being directed towards the impression cylinder 1. The blowing box 40 may have a structure analogous to that of the suction box 19 of FIG. 3, wherein the flow resistance decreases as the distance from the blowing box 40 increases. It is thereby possible, already in the region of the impression cylinder 1, after the sheet has been printed, for this printed sheet to be acted upon by blown air directed concentrically to the axis of the impression cylinder 1, uniformly over virtually the entire guidance region of the impression cylinder 1, and thus for the sheet to be securely pressed against the outer cylindrical surface of the impression cylinder 1.

By combining such a blowing box 36 on the impression cylinder 1 with a blowing box 41 or a suction box 19, 6 or 11, for example, on the delivery shaft and drum 2, a sheet of paper can thus be securely guided over the critical curvature region of the impression cylinder 1, through the sheet-transfer location between the impression cylinder 1 and the delivery drum 2, with the consequent change in the curvature of the sheet guidance, and over the entire sheet-guiding region of the delivery to the sheet pile 5.

We claim:

1. Printing machine with a sheet-guiding surface, comprising a pneumatic-flow box with a cover surface, at least part of the sheet-guiding surface of the printing machine forming the cover surface of said pneumatic-flow box, said cover surface being formed with pass-through openings for pneumatic fluid, a pneumatic-flow nozzle connecting said pneumatic-flow box to a source for supplying pneumatic fluid to said pneumatic-flow box, said pneumatic-flow box having means for producing a flow resistance profile decreasing therein with increasing distance from a location at which said pneumatic-flow nozzle is connected to said pneumatic-flow box.

2. Printing machine according to claim 1, including a pneumatic-flow path extending from said connection location in said pneumatic-flow box, and including said flow resistance producing means flow resistance-forming bodies extending from said cover surface into said pneumatic-flow path in said pneumatic-flow box and being disposed in succession therein, said bodies offering respective flow resistances to the pneumatic fluid which decrease with increasing distance from said connection location.

3. Printing machine according to claim 2, wherein said flow-resistance-forming bodies are baffles.

4. Printing machine according to claim 3, wherein said baffles have a varying length and decrease in length with increasing distance thereof along said pneumatic-flow path from said connection location.

5. Printing machine according to claim 3, wherein said baffles are disposed in said pneumatic-flow path at respective angles to oncoming pneumatic flow which decrease with increasing distance of said baffles from said connection location.

6. Printing machine according to claim 3, wherein respective spacings between respective mutually adjacent pairs of said baffles increase with increasing distance of said baffles from said connection location.

7. Printing machine with a sheet-guiding surface, comprising a suction box with a cover surface, at least part of the sheet-guiding surface of the printing machine forming the cover surface of said suction box, the cover surface being formed with pass-through openings for suction air, a suction nozzle connecting said suction box to a source for supplying suction air to said suction box, said suction box having means for producing a flow resistance profile decreasing therein with increasing distance from a location at which said suction nozzle is connected to said suction box.

8. Printing machine according to claim 7, including a delivery drum having a sheet-guiding region for effecting a deflection of a guided sheet, said suction box being secured outside said delivery drum, and said sheet-guiding cover surface thereof being disposed concentrically with said delivery drum and being formed with perforations disposed in accordance with said deflection.

9. Printing machine with a sheet-guiding surface, comprising a blowing box with a cover surface, at least part of the sheet-guiding surface of the printing machine forming the cover surface of said blowing box, the cover surface being formed with pass-through openings for blowing air, comprising a blast nozzle connecting said blowing box to a source for supplying blowing air to said blowing box, said blowing box having means for producing a flow resistance profile decreasing therein with increasing distance from a location at which said blast nozzle is connected to said blowing box.

10. Printing machine according to claim 9, including an impression cylinder having a sheet-guiding region for effecting a deflection of a guided sheet, said blowing box being secured outside said impression cylinder, said pass-through openings formed in said sheet-guiding cover surface of said blowing box being perforations arranged for guiding the sheet from outside the impression cylinder.

11. Printing machine according to claim 10, wherein said cover surface is concentric with said impression cylinder and faces from outside said impression cylinder towards said sheet-guiding region of said impression cylinder.

12. Printing machine according to claim 9, including a delivery drum having a sheet-deflecting guiding region and a further blowing box secured within said delivery drum, and said cover surface of said suction box facing towards said sheet-deflecting guiding region of said delivery drum, said cover surface being disposed concentrically with said delivery drum and being formed with perforations disposed in accordance with the deflection of a deflected sheet.

13. Printing machine with a sheet-guiding surface, comprising a blowing box with a cover surface, at least part of the sheet-guiding surface of the printing machine forming the cover surface of said blowing box, the cover surface being formed with pass-through openings for blowing air, comprising a blast nozzle connecting said blowing box to a source for supplying blowing air to said blowing box, said blowing box having means for producing a flow resistance profile decreasing therein with increasing distance from a location at which said blast nozzle is connected to said blowing box, an impression cylinder having a sheet-guiding region for effecting a deflection of a guided sheet, said blowing box being secured outside said impression cylinder, said pass-through openings formed in said sheet-guiding cover surface of said blowing box being perforations arranged for guiding the sheet from outside the impression cylinder, and including a delivery drum having a sheet-deflecting guiding region, a further blowing box secured within said delivery drum and having a cover surface facing towards said sheet-deflecting guiding region of said delivery drum, said cover surface of said further blowing box being disposed concentrically with said delivery drum and being formed with perforations disposed in accordance with the deflection of a deflected sheet.

* * * * *